US008715022B2

(12) United States Patent
Martens

(10) Patent No.: US 8,715,022 B2
(45) Date of Patent: May 6, 2014

(54) MARINE VESSEL TRANSMISSION

(75) Inventor: Dirk Martens, Coppenbrügge (DE)

(73) Assignee: Reintjes GmbH, Haneln (DE)

( * ) Notice: Subject to any disclaimer, the term of this patent is extended or adjusted under 35 U.S.C. 154(b) by 126 days.

(21) Appl. No.: 13/226,106

(22) Filed: Sep. 6, 2011

(65) Prior Publication Data

US 2012/0064784 A1 Mar. 15, 2012

(30) Foreign Application Priority Data

Sep. 7, 2010 (DE) ..... 10 2010 044 710

(51) Int. Cl.
*B63H 20/14* (2006.01)

(52) U.S. Cl.
USPC ..... 440/75

(58) Field of Classification Search
USPC ..... 440/75
See application file for complete search history.

(56) References Cited

U.S. PATENT DOCUMENTS

| | | | | |
|---|---|---|---|---|
| 2,635,048 | A | 4/1953 | Land | |
| 3,635,048 | A * | 1/1972 | Monti | 464/16 |
| 3,643,642 | A * | 2/1972 | Junes | 123/198 C |
| 3,669,230 | A | 6/1972 | Burkhardt et al. | |
| 4,368,048 | A * | 1/1983 | Wedler | 440/75 |
| 4,595,371 | A * | 6/1986 | Heston | 440/75 |
| 5,171,176 | A | 12/1992 | Gebhardt et al. | |
| 2006/0259200 | A1* | 11/2006 | Choi et al. | 700/287 |
| 2009/0163094 | A1* | 6/2009 | Fukuoka | 440/88 P |
| 2009/0280701 | A1 | 11/2009 | Schmidt et al. | |
| 2009/0309461 | A1* | 12/2009 | Berenger et al. | 310/67 R |

FOREIGN PATENT DOCUMENTS

| | | | |
|---|---|---|---|
| DE | 1 945 797 | A | 4/1971 |
| DE | 25 01 675 | A | 12/1975 |
| DE | 25 01 675 | C3 | 2/1979 |
| DE | 3536448 | A1 | 4/1987 |
| DE | 40 36 578 | C2 | 12/1993 |
| DE | 10 2008 018 703 | A1 | 10/2009 |
| EP | 0117881 | A1 | 9/1984 |
| EP | 0249208 | A1 | 12/1987 |
| FR | 894 621 | A | 12/1944 |
| FR | 894621 | A | 12/1944 |
| FR | 1 154 773 | A | 4/1958 |
| FR | 1154773 | A | 4/1958 |
| GB | 1 318 786 | A | 5/1973 |

OTHER PUBLICATIONS

EPO Search Report; Jan. 26, 2012.

* cited by examiner

*Primary Examiner* — Stephen Avila
(74) *Attorney, Agent, or Firm* — Whitham Curtis Christofferson & Cook, PC

(57) ABSTRACT

Marine vessel transmission with an input drive shaft which extends along an input drive shaft axis and is designed to be connected to a marine engine, an output drive shaft which is designed to provide a torque to a propeller and has a gear reduction for the input drive shaft, a housing which partially surrounds the input drive shaft and the output drive shaft, a secondary output drive shaft having a torque introduction journal that protrudes from the housing and on which a secondary output drive gearwheel is arranged, which is located in the torque path behind the input drive shaft, and an electric generator which features a rotor which is interlocked with the torque introduction journal, whereby the rotor runs coaxially to the secondary output drive shaft and is borne mechanically determined onto the torque introduction journal.

8 Claims, 5 Drawing Sheets

MARINE VESSEL TRANSMISSION

BACKGROUND AND SUMMARY

This invention relates to a marine vessel transmission with (a) an input drive shaft extending along an input drive shaft axis designed to connect to a marine engine, (b) an output drive shaft designed to apply a torque to a propeller having a gear reduction for the input drive shaft, (c) a housing which at least partially surrounds the input drive shaft and the output drive shaft, and (d) a secondary output drive shaft which protrudes from the housing in a torque introduction journal and is arranged on a secondary output drive shaft gearwheel, which is arranged in the torque path located behind the input drive shaft.

Prior marine vessel transmissions are known, such as DE 1 945 797 or the DE 10 2008 018 703 A1. Marine vessel transmissions are designed to be connected to a main engine of a marine vessel from which they receive a torque, which is transferred by the transmission to the propeller of the marine vessel in an altered form. In order to supply electrical units of the marine vessel with power, it is known, on one part of the transmission to channel a portion of the engine output torque to an electric generator that supplies power for the on-board electrical network.

The disadvantage of known marine vessel transmissions is that there is a relatively high amount of wear at the coupling point between the generator and the torque induction journal.

FR 894 621 A discloses a steam turbine in which a rotor of a generator is permanently connected with a turbine shaft and the junction between rotor and turbine shaft acts as storage for the rotor on one side.

U.S. Pat. No. 3,635,048 discloses a gear coupling which surrounds the two gear wheels and where the oil from one housing side of the gear coupling is directed through the area between the gear wheels to the other housing side of the gear coupling.

The aim of the invention is to reduce the wear at the coupling point between the generator and the torque induction journal. The invention solves the problem by means of a marine vessel transmission in accordance with claim 1.

The invention has an advantage in that the rotor is mechanically defined and is not borne in a mechanically overly-constrained way as is the case with solutions provided from the prior art. In this way the present rotor can feature a bearing, for example a rolling bearing, which touches one side of the rotor. On the opposite side the rotor is borne onto a torque introduction journal, without which a further bearing would be required on this end.

Another advantage is that installation space for a further bearing is saved, since the rotor is directly borne onto the torque induction journal, which reduces the necessary installation space.

A further advantage of the solution created by this invention is the reduced wear. Since the generator does not project as far out because of the direct bearing on the torque induction journal, the generator is less susceptible to vibrations. During operation, marine vessel transmissions vibrate constantly, as they generally share a foundation with a marine diesel. This vibration is transferred onto the generator, whose free end vibrates relatively to the housing of the marine vessel transmission. This vibration spreads to the junction between the secondary output drive shaft and the rotor which can result in the wearing down of the areas of contact between the two. The less the electric generator protrudes from the housing, the smaller the amplitude of this vibration at the junction and thus the less significant the wear.

Within the framework of the description at hand, the term marine vessel transmission is in particular understood to mean a transmission with which a crash-stop maneuver can be carried out multiple times, whereby the term crash-stop maneuver is understood to mean a maneuver in which the negative value of the nominal torque can be applied whilst driving ahead at full speed with the nominal torque.

The electric generator is preferably attached to the housing in such a way that it can be detached. For example, the generator possesses a generator housing with which it is interlocked with, or as the case may be screwed onto, the housing of the marine vessel transmission. This enables the generator to be exchanged quickly. Furthermore, it is possible to run the marine vessel transmission without the generator and to add the generator at a later date.

The electric generator is preferably connected with the secondary output drive shaft by means of an interlocking connection, e.g. splined shaft, feather key, splined couplings or toothed shaft. Such a connection is particularly robust and resilient against vibrations.

It is preferable that the electric generator is designed in such a way that it can also be run as an electric motor, especially if the generator is designed so that it can be run as an asynchronous (induction) motor.

In one application, the secondary output drive gearwheel is stepped up with regards to the input drive shaft. If the secondary output drive gearwheel is stepped up with regards to the input drive shaft, it means that it rotates more quickly than the input device shaft. In this case, the use of a generator in the form of an asynchronous generator is particularly convenient. Synchronous generators have a smaller installation space at the same power rating, so it would initially be expected that the use of a synchronous generator or synchronous engine is more convenient. However, the same amount of power can be harnessed with an asynchronous generator in the same or smaller installation space as with a synchronous generator. An added advantage is that a synchronous generator creates higher voltages at high speeds than an asynchronous generator. However, highly variable voltages require a lot of energy during the processing of the electrical power, meaning that the combination of a step-up transmission and the use of an induction generator is particularly advantageous.

It is especially favourable if the input drive shaft is coupled with the torque induction journal with a gear transmission ratio of at least 1 to 1.5, whereby the gear transmission ratio is preferably smaller than 1 to 3. In other words, for every rotation of the input drive shaft, the torque pin does at least 1.5, or a maximum of 3 rotations.

A transmission ratio between 2 and 2.4 is particularly favourable. The generator can be used effectively as a motor with these given gear transmission ratios. Electric generators or engines have a particularly small installation space at the same power rating, the higher their speed of rotation. The larger the gear transmission ratio, the more favourable it is for the use of the generator as an auxiliary drive. The smaller the gear transmission ratio, the more convenient it is for the use of the generator for the production of electrical energy. The indicated transmission ratio range has proven itself to be the optimal compromise.

In accordance with a preferred embodiment of the invention, the marine vessel transmission is a reversible transmission. This means that all step-ups or reductions in both directions of rotation can be carried out immediately. This is especially advantageous if a marine vessel has two permanent propellers, as in a preferred embodiment. These permanent propellers must constantly rotate against each other, whereby the marine diesel constantly only rotates in one direction. In this way it is possible to drive both propellers with two structurally identical marine vessel transmissions.

In accordance with a preferred embodiment, the rotor is connected with the secondary output drive shaft at a junction and the secondary output drive shaft has an oil duct through which the oil can be conducted into the junction. For example, the oil duct is created through a central longitudinal bore through the secondary output drive shaft. It is then possible to direct oil though this oil duct from inside the housing to a free end of the torque induction journal protruding from the housing, so that the oil escaping there lubricates the junction between the rotor and the secondary output drive shaft.

It is particularly favourable if the rotor surrounds the secondary output drive shaft at the pin-end in such a way that the oil coming from the oil duct of the secondary output drive shaft can be directed away from the pin end. In other words, once the oil has left the oil duct, it flows in the direction of the housing, where it goes back into the housing through an oil opening. In this way, it is possible to use the oil which is already present in the marine vessel transmission to lubricate the joint.

The generator preferably has a housing and a shaft seal by means of which oil escaping the oil duct is prevented from leaking into the housing. This ensures that the electrical components of the generator cannot be damaged by oil.

It is preferable that the marine vessel transmission has (a) an input drive shaft gearwheel arranged on the input drive shaft, (b) a first pinion shaft which runs coaxially to the input shaft drive and upon which a first pinion is arranged, and (c) a second pinion shaft which runs parallel to the input drive shaft and upon which a pinion shaft gearwheel, which meshes with the input drive shaft, and a second pinion are arranged, whereby (d) a spur gear is arranged on the input drive shaft, which meshes with the first pinion and the second pinion. In a preferable embodiment, the secondary output drive gearwheel meshes with a secondary input drive gearwheel, whereby the secondary output drive gearwheel is arranged on the first pinion or the second pinion. This results in a particularly simply structured marine vessel transmission.

A switchable input drive shaft clutch may be arranged on the input drive shaft, by means of which the input drive shaft gearwheel can be connected with the first pinion shaft so that they rotate together. It is also useful if this input drive shaft clutch is a hydraulically switchable multiple disk clutch.

It is possible that, for example, the input drive shaft gearwheel and/or the pinion shaft gearwheel are designed as a tooth system of an external housing of the input drive shaft clutch.

Preferably, a hydraulically switchable pinion shaft clutch is arranged on the second pinion shaft, by means of which the pinion shaft gearwheel can be connected with the second pinion shaft so that they rotate together.

When activating the input drive shaft clutch and the pinion shaft clutch, it is favourable if an electric control unit is provided, which is designed in such a way that the input drive shaft clutch and the pinion shaft clutch can be switched, so that a maximum of one of the two constantly establishes a rotating connection.

In one embodiment, the marine vessel transmission has (i) an intermediate shaft on which a spur gear and a bevel pinion are arranged, (ii) an input drive shaft gearwheel arranged on the input drive shaft, (iii) a first pinion shaft which extends coaxially to the input drive shaft and on which a first pinion is arranged, and (iv) a second pinion shaft which runs parallel to the input drive shaft and on which a pinion shaft gearwheel, which meshes with the input drive shaft gearwheel, and a second pinion shaft are arranged, whereby the first pinion and the second pinion mesh with the spur gear, and a spur bevel gear is arranged on the output drive shaft which, together with the bevel pinion, forms a bevel drive unit. This type of marine vessel transmission is particularly well suited to a Z-motor which is used, for example, in yachts. Preferably, the output drive shaft extends along an output drive shaft axis which runs at an angle of 75° to the input drive shaft axis.

It is favourable if the generator has a power rating of between 50 and 150 kilowatts. A power rating of the marine vessel transmission can thus be between, for example, 8 and 12 times larger than the power rating of the generator.

The invention also encompasses a marine propulsion with a diesel engine, a marine vessel transmission according to the invention, whose input drive shaft is connected to the diesel engine, and a permanent propeller, which is drivable by means of the output drive shaft or is at least indirectly coupled with the output drive shaft. It is favourable if this marine propulsion has a converter to change a frequency into a current indicated by the generator. This converter can also work particularly well as a rectifier, so that a battery pack can be recharged as an energy storage device. It is favourable if the marine vessel transmission is connected with the marine propulsion without having to use the clutch, meaning that a smaller installation space is required.

Preferably, the marine propulsion possesses an electric energy storage device in the form of at least a rechargeable battery, which is connected with the converter in such a way that it can be recharged by the generator. The rectifier can then act as an inverter so that the generator is supplied with electrical power of a specified voltage and frequency in such a way that a predefined torque is applied to an output drive shaft. The marine vessel transmission is preferably designed in such a way that in the installation position of the marine vessel transmission, the input drive shaft axis runs primarily horizontally.

BRIEF DESCRIPTION OF THE DRAWINGS

In the following, the invention is explained in more detail by means of design examples, referring to the attached diagrams. These diagrams show

DETAILED DESCRIPTION OF THE DRAWINGS

Figure 1:
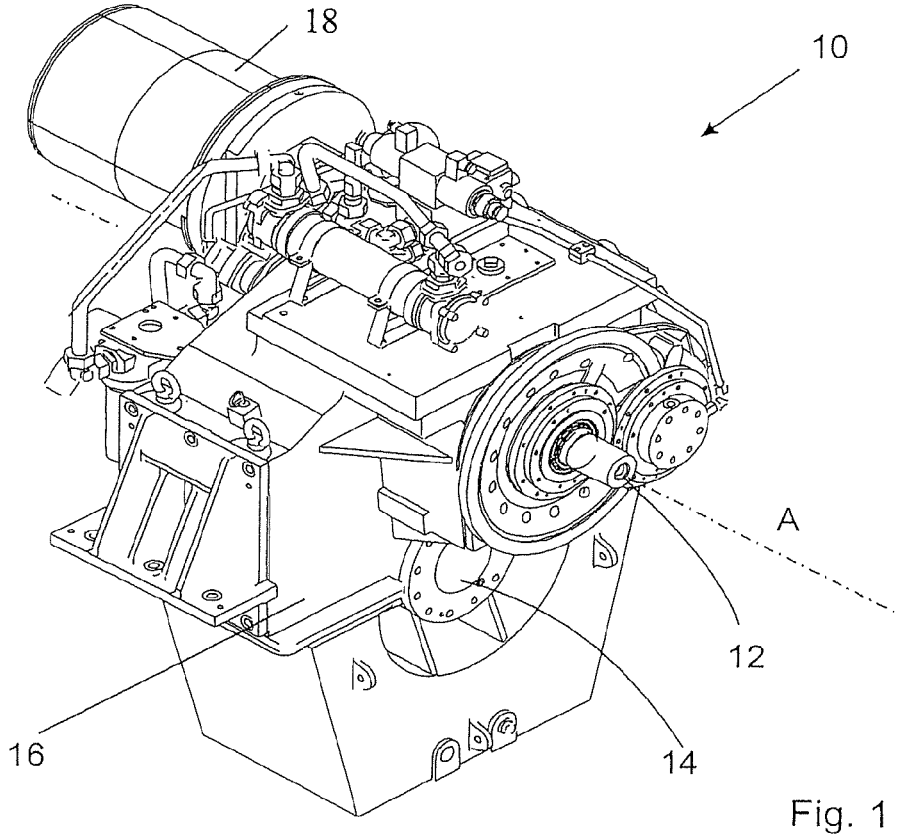
FIG. 1 is a perspective external view of a marine vessel transmission according to the invention.

FIG. 1 shows an external view of a marine vessel transmission 10 according to the invention, with an input drive shaft 12 that extends along an input drive shaft axis A and is designed to be connected to a marine engine, not shown here, for example in the form of a diesel engine.

In addition, the marine vessel transmission 10 includes an output drive shaft 14 which, in contrast to the input drive shaft 12, has a gear reduction from, for example, 1 to 1.5 up to 1 to 8. The input drive shaft 12 and the output drive shaft 14 are at least partially surrounded by a housing 16 on which a generator 18 is flange-mounted.

Figure 2:
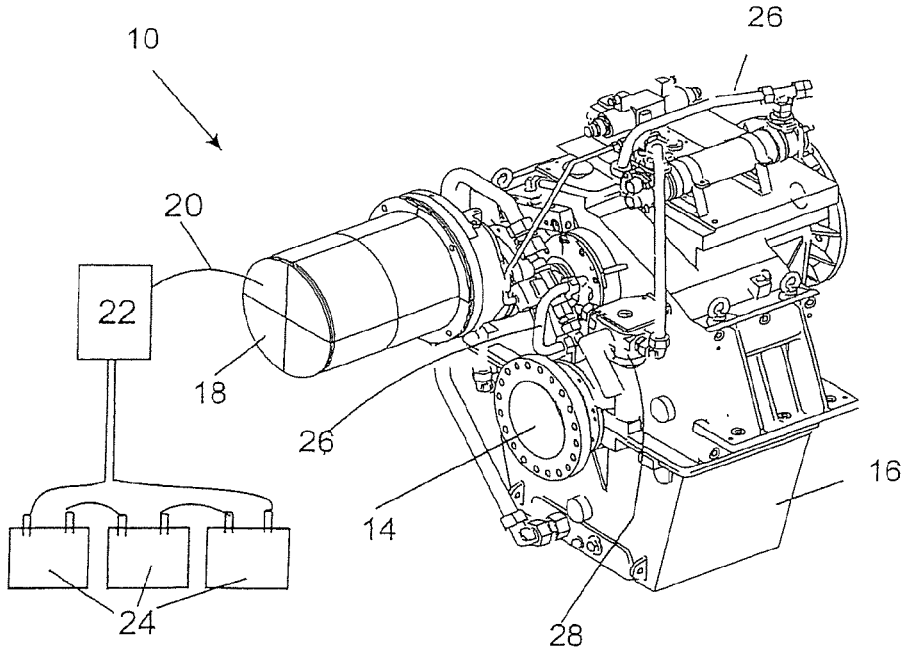
FIG. 2 is a schematic view of a second perspective view of the marine vessel transmission in accordance with FIG. 1.

FIG. 2 shows the marine vessel transmission 10 from another perspective. It depicts a schematic diagram of an electrical connection 20 between the generator 18 and a converter 22, which is also schematically depicted. The converter 22 includes output electronics, for example in the form of thryistors, in order to produce a DC voltage from the alternating current coming from the generator 18, in order to recharge the battery pack 24. Power can also be transferred to the existing on-board electrical network. In this case, the desired number of rotations can be adjusted from frequency produced to the frequency of the on-board network by the converter. The converter 22 is also designed to perform frequency inversion on electrical power extracted from the battery pack, such that the generator 18, as an asynchronous electric motor, functions as an engine. In this way, a particularly advantageous slow operation is possible, as the speed range can continuously be driven forwards and backwards. It is, however, not necessary for the generator to be based on the principle of an asynchronous motor; it is also possible that it concerns a synchronous motor. FIG. 2 also shows externally arranged oil lines 26, as well as an oil filter 28, by means of which oil available in the housing can be continuously cleaned during the operation of the marine vessel transmission.

Figure 3:
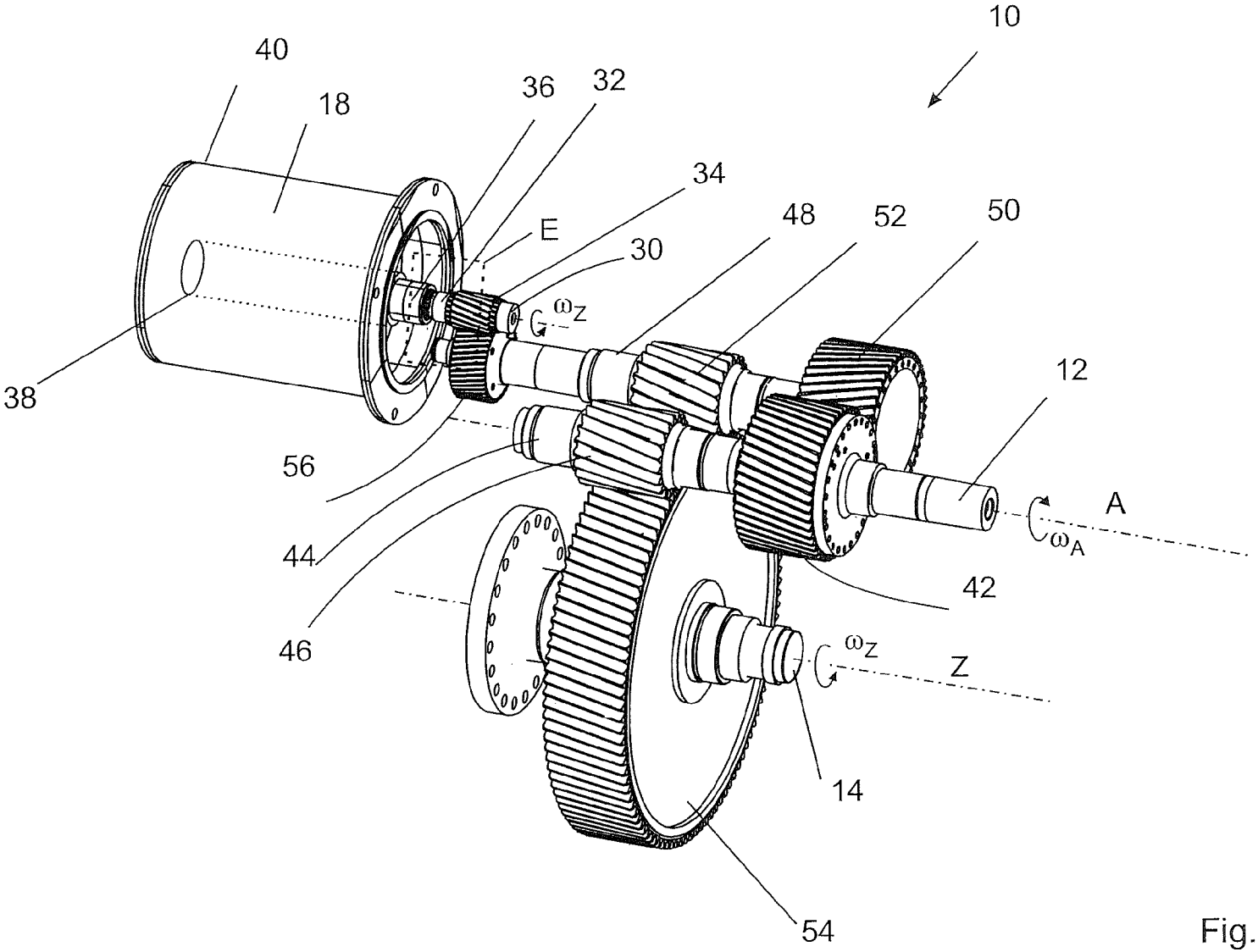
FIG. 3 is a schematic perspective view of the shafts and gearwheels, as well as the marine vessel transmission.
Figures 4, 4A, 4B:
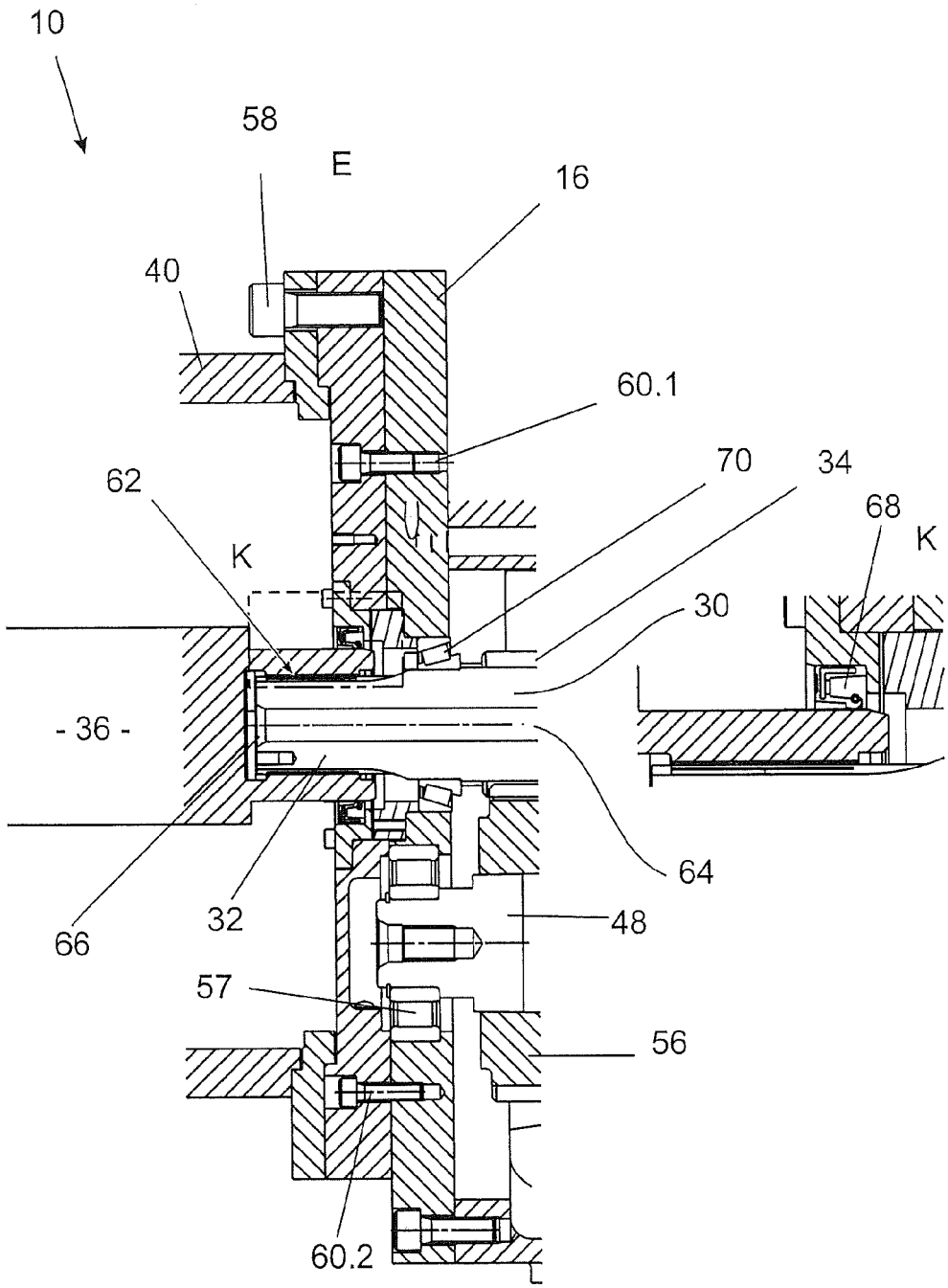
FIG. 4*a* is a cross-sectional view cut through the junction between secondary output drive shafts.
FIG. 4*b* is a detail in accordance with section K of FIG. 4*a*.

FIG. 3 shows the marine vessel transmission 10 without the housing. It should be noted that the marine vessel transmission has a secondary output drive shaft 30. The secondary output drive shaft 30 includes a torque introduction journal 32 that extends beyond the housing, as shown in FIG. 4*a*. A secondary output shaft gearwheel 34 arranged on the secondary output drive shaft 30 is surrounded by the housing.

The generator 18 possesses a rotor 36 that runs coaxially to the secondary output drive shaft 30 and is interlocked with it. A bearing 38 is schematically depicted in FIG. 3, which can be, for example, a rolling bearing, by means of which the rotor 36 is borne onto one end on a generator housing. On the opposite side to the bearing 38, the rotor 36 is borne onto the secondary output drive shaft 30, which represents the only bearing on this side of the rotor 36.

On the input drive shaft 12, the marine vessel transmission has an input drive shaft gearwheel 42 and a first pinion shaft 44, which extends coaxially to the input drive shaft 12 and on which a first pinion 46 is arranged. The marine vessel transmission also includes a second pinion shaft 48, which runs parallel to the input drive shaft 12 and on which a pinion shaft gearwheel 50 is arranged, which meshes with the input drive shaft gearwheel 42. Furthermore, a second pinion 52 is arranged on the second pinion shaft 48, which meshes with a spur gear 54 on the output drive shaft 14, like the first pinion 46.

Figure 6:
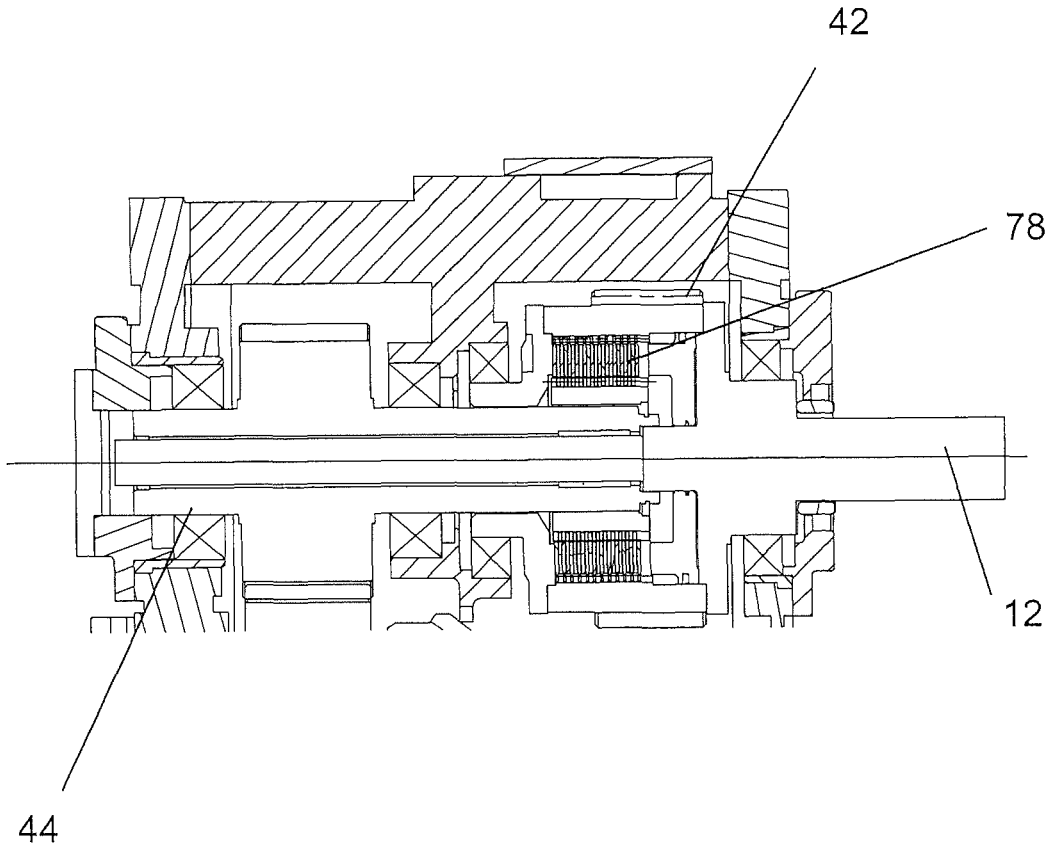
FIG. 6 is a partial cross sectional view.

The pinion shaft gearwheel 50 and the input drive shaft gearwheel 42 are connected switchably with the second pinion shaft 48 and the input drive shaft 12 respectively via input drive shaft clutches shown in FIG. 6. In the present case, the input drive shaft clutches concern hydraulically switchable multiple disc clutches. Should the input drive shaft clutch belonging to the input drive shaft gearwheel 42 be closed, a rotation of the input drive shaft 12 with an output drive circuit frequency $\omega_A$ leads to a rotation of the output drive shaft 14 around the output drive shaft axis Z with the output drive circuit frequency $\omega_Z$, the absolute value of which being smaller than the input drive circuit frequency $\omega_A$. In this case, the input drive shaft clutch belonging to the pinion shaft gearwheel 50 is open and the second pinion 52 is rotated by the spur gear 54. A secondary output drive-input drive shaft gearwheel 56 is mounted on the second pinion shaft 48 and rotated with the input drive circuit frequency $\omega_A$ in the same way as the rotation of the second pinion shaft 48. This results in a secondary output drive circuit frequency $\omega_N$ of the secondary output drive gearwheel 34, the absolute value which is larger than the input drive circuit frequency $\omega_A$. By opening the closed input drive shaft clutch and by closing the opened input drive shaft clutch the direction of rotation of the output drive shaft 14 is immediately reversed by the same amount of the output drive circuit frequency.

FIG. 4*a* shows a cross section referring to level E in FIG. 3. It should be noted that the second pinion shaft 48 is borne in a rolling bearing 57 on the housing 16 such that the secondary output drive-input drive shaft gearwheel 56 meshes with the secondary output drive gearwheel 34. The secondary output drive shaft 30 is borne in a bearing 70 on the housing 16 and includes a torque introduction journal 32 projecting from the housing 16. The generator housing 40 is fixed onto the housing by means of screws 58 and 60.1, 60.2.

The rotor 36 of the generator 18 is interlocked with the torque introduction journal 32 at a junction 62 by a splined connection. Alternatively, the rotor 36 in interlocked with the torque introduction journal 32 at junction 62 using another interlocking connection, such as a feather key, splined couplings, toothed shaft, or other mechanically defined interlocking connections. The rotor 36 is installed without a bearing in the generator housing 40 at the end adjacent the torque introduction journal 32. In this way, the rotor 36 is borne in the generator housing 40 by the bearing 38 on one end and the torque introduction journal 32 on the other end.

The secondary output drive shaft 30 includes an oil duct 64 through which oil is directed from the inside of the housing 16 into the area around the junction 62. In addition, the oil is further directed into the oil duct 64 by means of an oil pump, not shown here, for example a gear pump. The oil leaves the oil duct 64 via a pin end 66 and then flows towards the junction 62 on the housing 16. The rotor 36 surrounds the secondary output drive shaft 30 at the pin end 66, so that the oil in the vicinity of the pin end 66 can flow out neither radial nor axial from the housing 16. Rather, it flows axially on the outside of the torque introduction journal 32 in the direction of the housing 16.

FIG. 4*b* shows an enlarged image of section K. It should be noted that on one of the rotor ends of the rotor 36 facing the housing 16, a shaft seal 68 is arranged, which prevents oil from being able to leak into the generator housing 40 and ensures that the oil arrives back in the housing 16 via the bearing 70 (cf. FIG. 4*a*).

Figure 5:
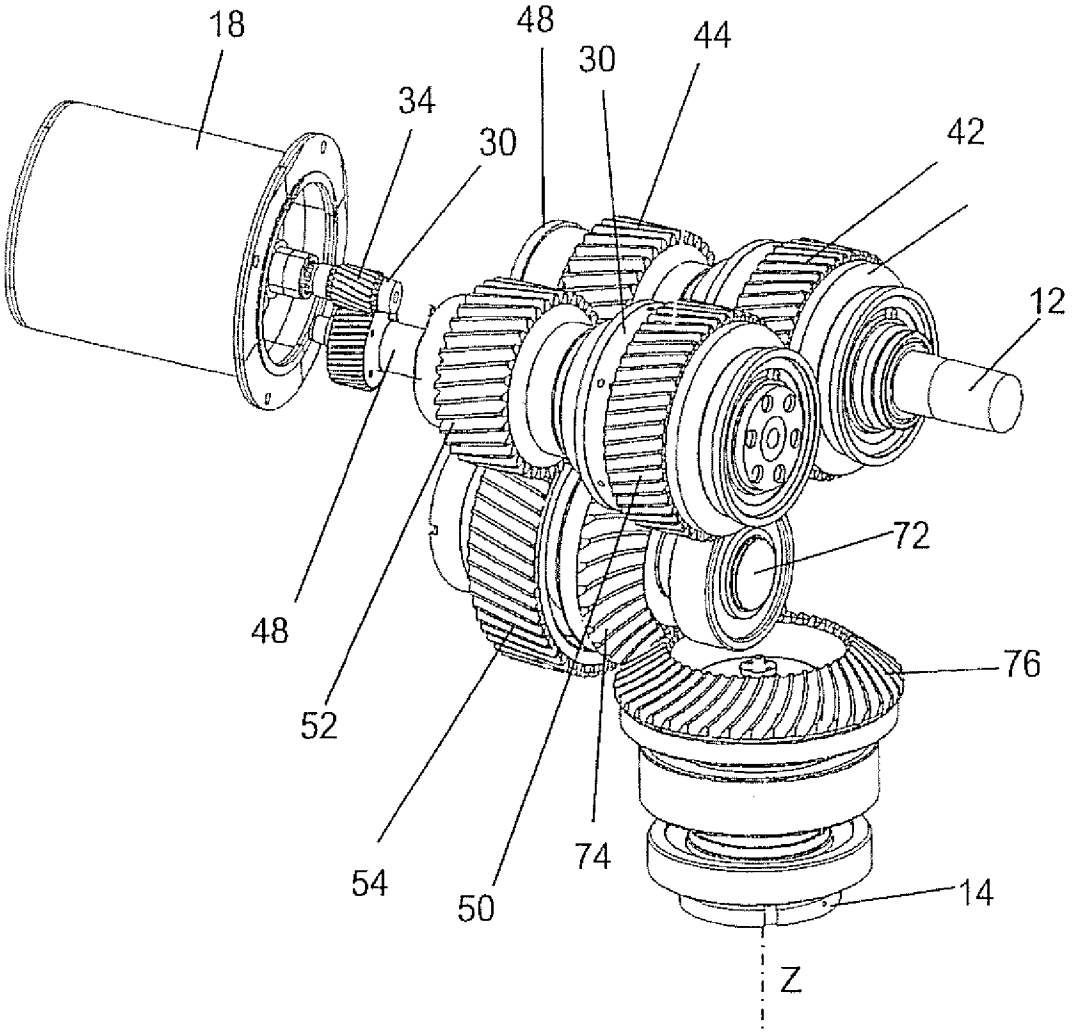
FIG. 5 is an alternative embodiment of a marine vessel transmission for a Z-motor according to the invention.

FIG. 5 shows a second embodiment of a marine vessel transmission according to the invention with the input drive shaft 12, the output drive shaft 14, housing, not shown here, the generator 18 and the shafts and gearwheels described above. Unlike in the solution described above, the spur gear 54 is not located on the output drive shaft, but on the intermediate shaft 72, on which a bevel pinion 74 is also attached. The bevel pinion 74 and a spur gear 76, which is fixed onto the input drive shaft 14, form a bevel drive. The output drive shaft 14 extends along an output drive shaft axis Z, which, in the present case, runs at a right angle (a=90°) to the input drive shaft axis.

FIG. 6 shows a longitudinal cut through the input drive shaft 12. It should be noted that the input drive shaft gearwheel 42 is connected with an input drive shaft clutch 78. The input drive shaft clutch 78 is designed in the form of a hydraulically switchable multiple disk clutch whose disks are partially connected with the input drive shaft gearwheel 42. The other disks of the input drive shaft clutch 78 are connected with the first pinion shaft 44, so that the torque can be transferred onto this. In the same way, the pinion shaft gearwheel 50 can be connected to the second pinion shaft 48 via a second input drive shaft clutch, so that it can be detached and the torque restrained.

According to the invention, there is also a procedure for driving a marine vessel by means of a marine vessel transmission according to the invention: when a predefined minimum speed is not reached, the input drive shaft clutch is changed by a diesel engine which is connected to the input drive shaft 12. This is done in such a way that no more speed from the diesel engine is transferred to the input drive shaft of the marine vessel transmission. The generator 18 is then supplied with power in such a way that it applies a torque to the output drive shaft 14 via the secondary output drive-input drive gearwheel 56. In addition, electrical power can, for example, be extracted from a setting on a battery pack and converted by a converter into a frequency suitable for a variable current. The power can also be supplied to the on-board network by diesel generators.

LIST OF REFERENCE SYMBOLS

10 Marine vessel transmission
12 Input drive shaft
14 Output drive shaft
16 Housing
18 Generator
20 Electrical connection
22 Converter
24 Battery pack
26 Oil line
28 Oil filter
30 Secondary output drive shaft
32 Torque introduction journal
34 Secondary output gearwheel
36 Rotor
38 Bearing
40 Generator housing
42 Input drive shaft gearwheel
44 First pinion shaft
46 First pinion
48 Second pinion shaft
50 Pinion shaft gearwheel
52 Second pinion
54 Spur gear
56 Secondary output-input gearwheel
57 Rolling bearing
58 Screw
60 Dowel
62 Junction
64 Oil duct
66 Pin end
68 Shift seal
70 Bearing
72 Intermediate shaft
74 Bevel pinion
76 Spur gear
78 Input drive shaft clutch
$\omega_A$ Input drive circuit frequency
$\omega_Z$ Output drive circuit frequency
$\omega_N$ Secondary output drive circuit frequency
A Input drive shaft axis
Z Output drive shaft axis

What is claimed is:

1. A marine vessel transmission comprising:
an input drive shaft extends along an input drive shaft axis;
an output drive shaft has a gear reduction from the input drive shaft;
a housing at least partially surrounds the input drive shaft and the output drive shaft;
a secondary output drive shaft has a torque introduction journal protruding from the housing;
a secondary output gearwheel is arranged on the secondary output drive in a torque path behind the input drive shaft; and
an electric generator has a rotor interlocked with the torque introduction journal,
wherein the rotor connects to the secondary output drive shaft at a junction,
wherein the secondary output drive shaft has an oil duct through which oil passes from inside the housing into the junction,
wherein the rotor surrounds the pin-end of the secondary output drive shaft in such a way that oil escaping from the pin-end is conducted between the rotor and the secondary output drive shaft away from the pin-end in a direction towards the housing.

2. A marine vessel transmission comprising:
an input drive shaft extends along an input drive shaft axis;
an output drive shaft has a gear reduction from the input drive shaft;
a housing at least partially surrounds the input drive shaft and the output drive shaft;
a secondary output drive shaft has a torque introduction journal protruding from the housing;
a secondary output gearwheel is arranged on the secondary output drive shaft in a torque path behind the input drive shaft; and
an electric generator has a rotor interlocked with the torque introduction journal, the electric generator is detachably mounted to the housing,
wherein the rotor is borne on one side by a bearing and on an opposite side by the secondary output drive shaft,
wherein the secondary output drive shaft has an oil duct through which oil passes from inside the housing into the junction, and wherein the rotor surrounds the pin-end of the secondary output drive shaft in such a way that oil escaping from the pin-end is conducted away from the pin-end between the rotor and the secondary output drive shaft along the secondary output drive shaft in a direction towards the housing.

3. The marine vessel transmission according to claim 2 further comprising:
an input drive shaft gearwheel is arranged on the input drive shaft;
a first pinion shaft extends coaxially to the input drive shaft;
a first pinion is arranged on the first pinion shaft;
a second pinion shaft runs parallel to the input drive shaft; and
a pinion shaft gearwheel and a second pinion are arranged on the second pinion shaft, the pinion shaft gearwheel meshes with the input drive shaft gearwheel,
whereby a spur gear is arranged on the output drive shaft meshing with the first pinion and the second pinion.

4. A marine vessel transmission according to claim 2, wherein the secondary output drive gearwheel meshes with a secondary output drive-input drive gearwheel, whereby the secondary output drive-input drive gearwheel is arranged on the first pinion shaft or the second pinion shaft.

5. The marine vessel transmission according to claim 2 further comprising:
an intermediate shaft on which a spur gear and a bevel pinion are arranged;

an input drive shaft gearwheel is arranged on the input drive shaft;

a first pinion shaft extends coaxially to the input drive shaft;

a first pinion is arranged on the first pinion shaft;

a second pinion shaft runs parallel to the input drive shaft; and a pinion shaft gearwheel and a second pinion are arranged on the second pinion shaft, the pinion shaft gearwheel meshes with the input drive shaft gearwheel, whereby the first pinion and the second pinion mesh with the spur gear, whereby a spur bevel gear is arranged on the output drive shaft forming a bevel drive with the bevel pinion.

6. The marine vessel transmission according to claim 2, wherein the electric generator has a power rating between 50 and 150 kilowatts.

7. The marine vessel transmission according to claim 1 further comprising:

a shaft sealing to seal the rotor with respect to the housing.

8. A marine vessel transmission comprising:

an input drive shaft extends along an input drive shaft axis;

an output drive shaft has a gear reduction from the input drive shaft;

a housing at least partially surrounds the input drive shaft and the output drive shaft;

a secondary output drive shaft has a torque introduction journal protruding from the housing;

a secondary output gearwheel is arranged on the secondary output drive shaft in a torque path behind the input drive shaft;

wherein the rotor runs coaxially to the secondary output drive shaft;

an electric generator has a rotor interlocked with the torque introduction journal, the electric generator is detachably mounted to the housing; and a single bearing only on a side of the rotor opposite to the torque introduction journal.

* * * * *